United States Patent [19]

Cohn et al.

[11] 4,026,227

[45] May 31, 1977

[54] METHOD AND APPARATUS FOR CONNECTING AND DISCONNECTING A SUPPORTIVE BUOYANT STRUCTURE TO AND FROM AN OFFSHORE TOWER JACKET

[75] Inventors: Arnold S. Cohn; Heinz K. Rohde; Albert M. Koehler, all of Houston, Tex.

[73] Assignee: Brown & Root, Inc., Houston, Tex.

[22] Filed: Sept. 2, 1975

[21] Appl. No.: 609,380

[52] U.S. Cl. ..... 114/264; 61/87; 285/18; 285/407

[51] Int. Cl.[2] ..... E02B 17/00

[58] Field of Search ..... 114/.5 D, 43.5 R, 258, 114/259, 263, 264, 266; 61/46.5, 65, 86, 87, 94, 96, 92; 403/310, 312; 285/18, 331, 365, 407, 413

[56] References Cited

UNITED STATES PATENTS

| | | | |
|---|---|---|---|
| 3,054,267 | 9/1962 | Alcorn et al. | 61/46.5 |
| 3,214,202 | 10/1965 | Maychark | 285/331 |
| 3,347,052 | 10/1967 | Steitle et al. | 114/.5 D |
| 3,633,369 | 1/1972 | Lawrence | 114/43.5 R |
| 3,859,804 | 1/1975 | Koehler et al. | 114/43.5 R |

*Primary Examiner*—Trygve M. Blix
*Assistant Examiner*—Charles E. Frankfort
*Attorney, Agent, or Firm*—Kenway & Jenney

[57] ABSTRACT

A method and apparatus for connecting and disconnecting a buoyant structure and tower jacket characterized by mutually telescope portions of mated stanchions extending between the buoyant structure and tower jacket, which telescopingly mated stanchion portions are mutually secured by clamping means guidingly carried by the buoyant structure.

14 Claims, 8 Drawing Figures

METHOD AND APPARATUS FOR CONNECTING AND DISCONNECTING A SUPPORTIVE BUOYANT STRUCTURE TO AND FROM AN OFFSHORE TOWER JACKET

BACKGROUND OF THE INVENTION

The present invention relates generally to a method and apparatus for connecting and disconnecting a supportive buoyant structure which is intended to transport and erect an offshore tower jacket alternately to and from the tower jacket. More particularly, the invention relates to an improved method and apparatus for rigidly connecting and locking together a supporative buoyant structure and an offshore tower jacket in such a way that the two structures can be positively connected to universally restrain relative movement of the structures and which can nonetheless be positively and reliably disconnected.

Specifically, the present invention constitutes improvements in relations to jacket handling techniques disclosed in United States Koehler et al U.S. Pat. No. 3,859,804 (Jan. 14, 1975) and Crout et al U.S. Pat. No. 3,823,564 (July 16, 1974), assigned to the assignee of the present invention. These improvements are designed to:

- Enhance the case and reliability with which jackets are detachably attached to buoyancy structures,
- facilitate the selective release of such jackets and buoyancy structures, and
- improve the reliability and ruggedness of connections maintaned between such jackets and buoyancy structures as they are towed into position and the jacket is installed on a seabed.

OBJECTS AND SUMMARY OF THE PREFERRED FORMS OF THE INVENTION

In light of the foregoing, it is a general object of the invention to provide a novel method and apparatus intended to accomplish objectives of the type noted above.

It is a particular object of the invention to provide a novel method and apparatus by means of which a supportive buoyant structure can be rigidly locked in connection with an offshore tower jacket in a manner capable of resisting forces exerted as the jacket is turned upright and placed on the floor of the body of water.

It is another object of the ivention to provide a method and apparatus by means of which a supportive buoyant structure can be positively connected to an offshore tower jacket and thereafter positively disconnected so that the supportive structure can be readily moved away from the jacket.

It is still another object of the invention to provide a novel method and apparatus capable of universally resisting movement of an offshore tower jacket aboard a supportive buoyant structre as a consequence of movement induced in the assembly by waves and wind.

It is yet still another object of the invention to provide an apparatus which is of sufficient strength to connect together a buoyant structure and an offshore tower jacket and resist loads incurred in the course of transporting and erecting the jacket.

It is a further object of the invention to provide a novel method and apparatus for connecting together a supportive buoyant structure and an offshore tower jacket in a highly reliable manner.

It is still a further object of the invention to provide a novel method and apparatus for connecting together an offshore tower jacket and a supportive buoyant structure in which the apparatus employed to effect the connection is reusable over essentially the same number of cycles as the supportive buoyant structure.

It is yet still a further object of the invention to provide a novel method and apparatus which connects an offshore tower jacket to a supportive buoyant structure in a manner such that the jacket is maintained in a position above the surface of the body of water to avoid undue hydrodynamic resistance to the movement of the assembly to a desired offshore location.

It is another object of the invention to provide a novel method and apparatus for connecting together an offshore tower jacket and a supportive buoyant structure in which the apparatus employed is safe to use and work around as the jacket is being constructed, transported, and erected at a desired offshore location.

An apparatus for connecting and disconnecting a supportive buoyant structure, intended to transport and erect an offshore tower jacket, alternately to or from the tower jacket and intended to meet the foregoing objectives involves a clamping means which is carried in a reciprocally movable relation by the buoyant structure. The clamping means rigidly but releasably clamps together the tower jacket and the buoyant structure. The apparatus further involves elongated, structural linking means which reciprocally moves the clamping means relative to the buoyant structure. The linking means is pivotally connected at one end to the clamping means. Bellcranking means serves to reciprocally move the linking means and as a consequence moves the clamping means alternately into or out of clamping relation with the tower jacket and the supportive buoyant structure to positively connect or disconnect the two structures. The bellcranking means is pivotally connected to the buoyant structure for rotation about an axis which is normally horizontally. Rotating means connected to the bellcranking means serves to rotate the bellcranking means in order to reciprocally move the linking means and the clamping means relative to the buoyant structure.

A method of connecting and disconnecting a supportive buoyant structure intended to transport and erect an offshore tower jacket alternately to or from the tower jacket and intended to meet the foregoing objectives entails a number of steps. The first of these involves axially mating opposed stanchions extending vertically between the buoyant structure and the tower jacket. The mating surfaces of the stanchions are clamped together and thereafter positively locked in this clamped relation prior to transporting the tower jacket and the buoyant structure to an offshore location. Once the desired offshore location is reached, the mating surfaces are positively unlocked and thereafter released from the previous clamped relation.

THE DRAWINGS

Other objects and advantages of the present invention will become apparent with reference to the detailed description to follow of a preferred embodiment thereof, wherein like reference numerals have been applied to like elements and in which.

Figure 7:
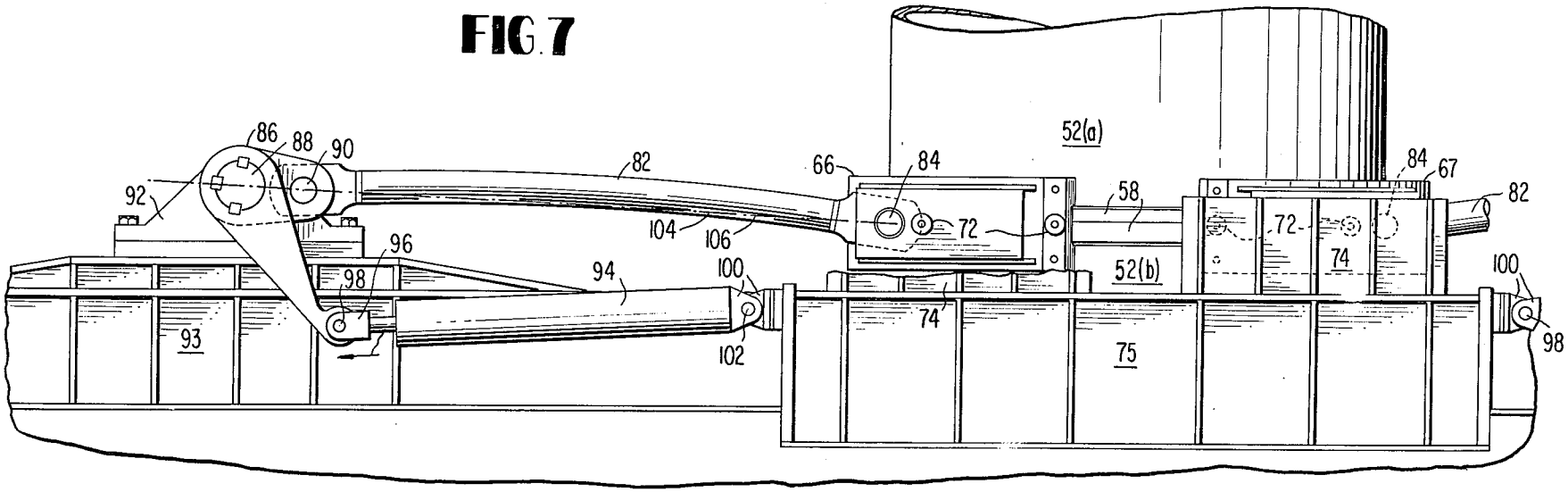
Figure 8:
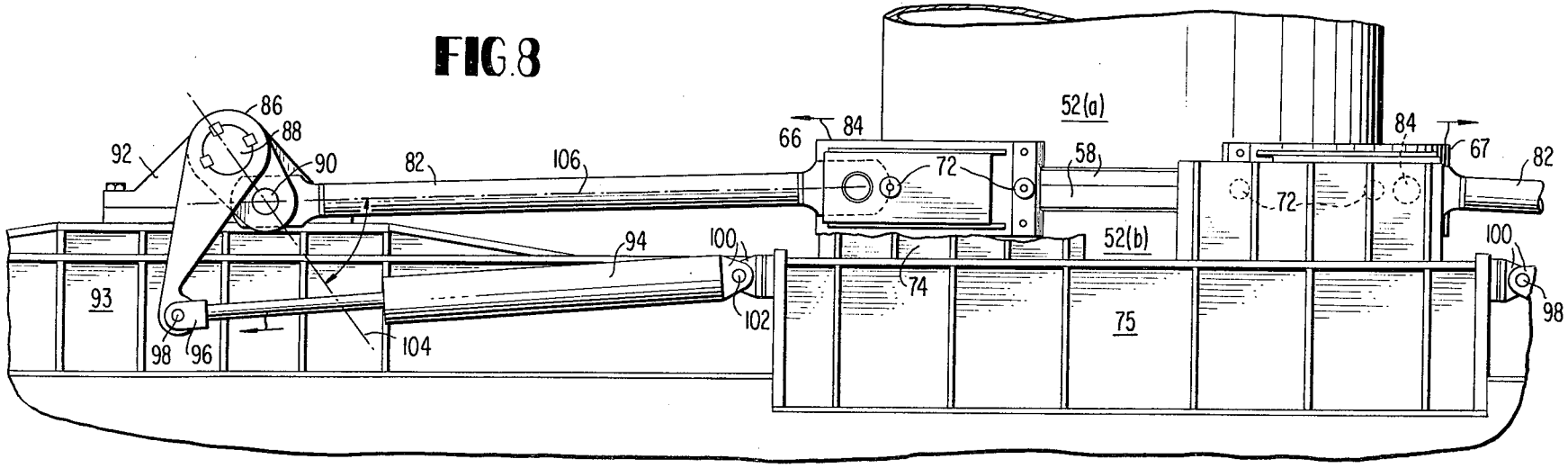

FIG. 7 is a side view of a preferred embodiment of an apparatus intended to connect the offshore tower jacket and supportive buoyant structure together as the process of disconnecting the structure is initiated; and FIG. 8 is a side view of a preferred embodiment of an apparatus intended to connect together an offshore tower jacket and a supportive buoyant structure with the process of disconnecting the structures substantially completed.

DETAILED DESCRIPTION

Figure 1:
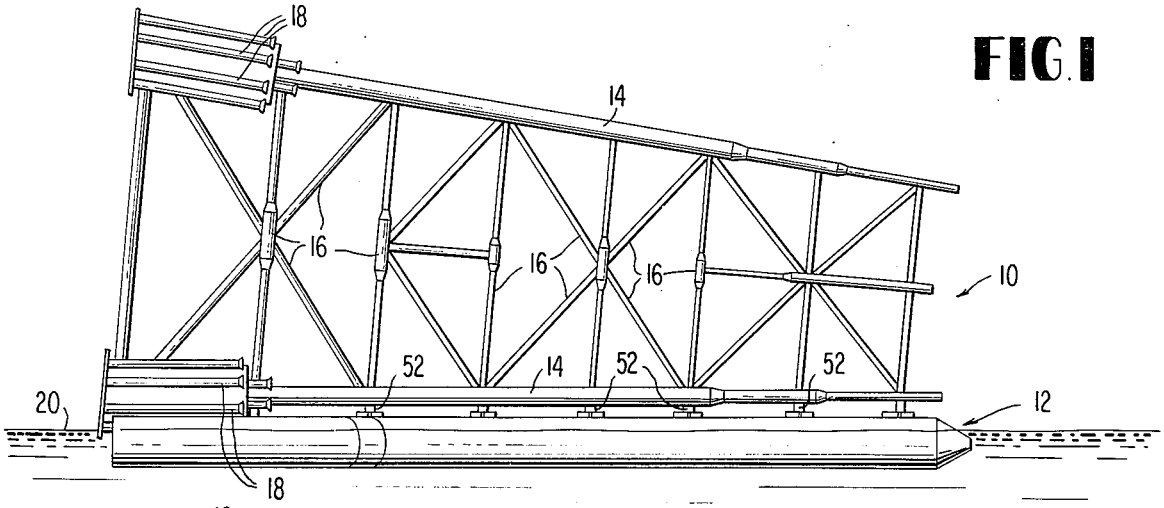
FIG. 1 is a side view of an offshore tower jacket and a supportive buoyant structure connected thereto.

Referring now in general to the drawings, and in particular to FIG. 1, an offshore tower jacket 10 and supportive buoyant structure 12 with which the method and apparatus of the invention are employed can be seen. As illustrated, the jacket 10 is comprised of a number of legs 14 interconnected and braced relative to one another by a plurality of struts 16. The lower ends of each leg are somewhat circumferentially enlarged to carry a plurality of individual piling guides 18. In actuality, any offshore tower jacket desired can be employed. The particular jacket illustrated in FIGS. 1 and 2 is illustrative only.

As illustrated in FIG. 1, the supportive buoyant structure 12 is a generally planar structure employed to support the offshore tower jacket 10 in a posture slightly above the surface 20 of the surrounding body of water. As perhaps best illustrated in FIG. 2, the supportive buoyant structure involves first and second tubular buoyancy members 22 and 24. These buoyancy members carry shaped nose portions 26 and 28 which afford a streamlined configuration tending to reduce the resistance offered by the buoyant structure to movement through a body of water. The ends of the tubular buoyancy members 22 and 24 opposite the shaped nose portions 26 and 28 are bifurcated. The bifurcations form inboard and outboard, watertight tubular members 30 and 32 and 34 and 36, respectively. These inboard and outboard tubular members are interconnected and braced relative to one another by transversely extending braces 38 and 40. The tubular buoyancy members 22 and 24, and the inboard, watertight tubular members 30 and 32 are interconnected by transversely extending buoyancy members 42, 44, 46, 48, and 50. Together the various elements afford a single, rigid structure which serves to support the offshore tower jacket 10 as it is transported from an area of assembly to a desired offshore location where the jacket is to be erected.

The two structures, i.e., the offshore tower jacket 10 and the supportive buoyant structure 12, are interconnected through a plurality of mating stanchion means 52 which extend between the jacket and the buoyant structure and which are arranged so that the jacket is maintained above the surface of the body of water as illustrated in FIG. 1. FIG. 2 illustrates schematically the locations of these stanchions. FIG. 2 also affords a view of the underside of the offshore tower jacket 10 as seen in FIG. 1. In other words, the two portions of the supportive buoyant structure 12 and the offshore tower jacket 10 illustrated in FIG. 2 face one another when the structures are connected together as illustrated in FIG. 1. To ensure safe transportion of the tower jacket to a desired offshore location the stanchions extending between the bouyant supportive structure and the offshore tower jacket are rigidly connected together in a unique manner to be described in more detail in the course of subsequent discussion.

Figure 2:
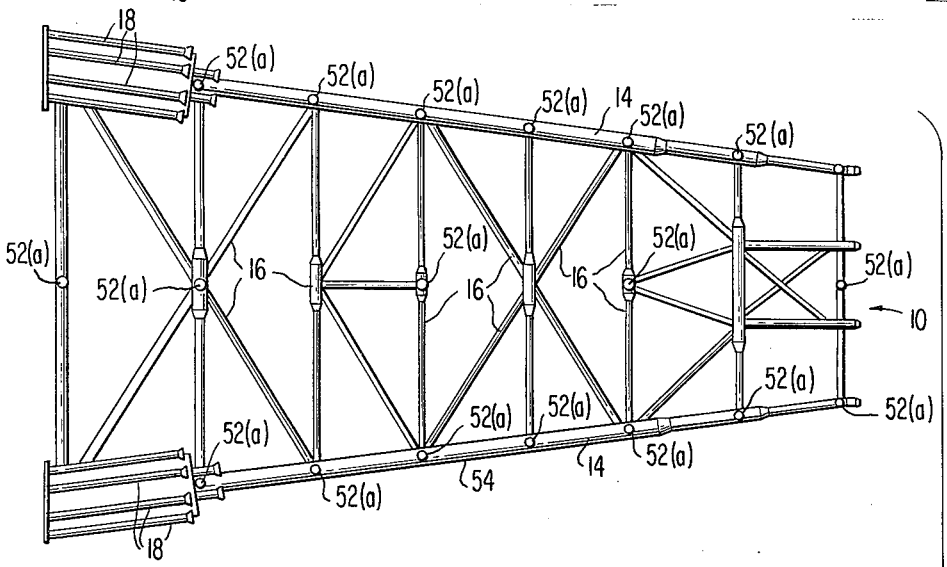
FIG. 2 is a plan view of the buoyant structure intended to support the offshore tower jacket and a view of the underside of the jacket intended to be received by the supportive buoyant structure.
Figure 2:
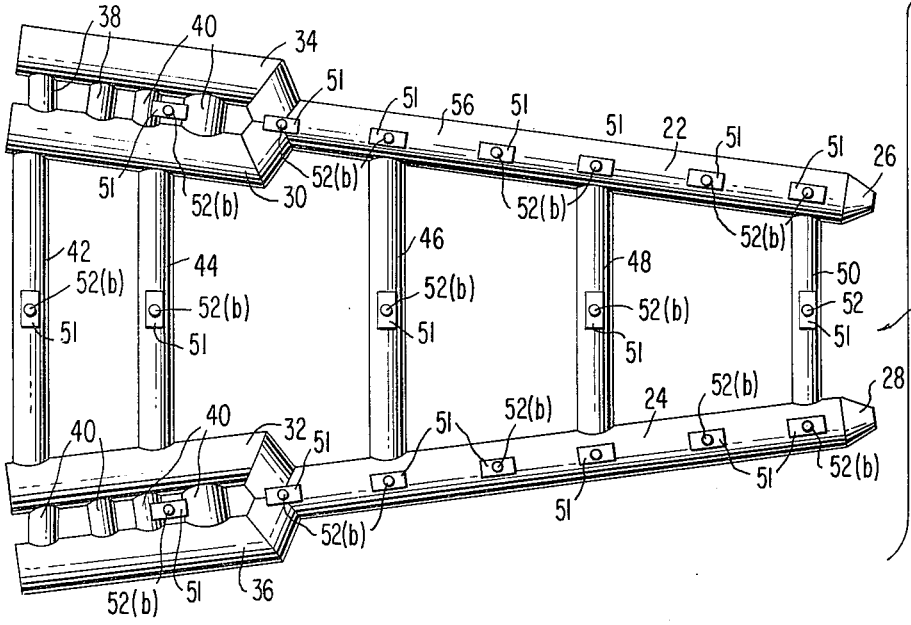

The offshore tower jacket 10 illustrated in FIGS. 1 and 2 is commonly constructed in a graving dock where the supportive buoyant structure rests temporarily on a dry bed. With the supportive buoyant structure resting on the dry bed of the graving dock, the offshore tower jacket is constructed directly atop the buoyant structure. In the course of this construction the stanchions which are to extend between the two structures are mated and the rigid interconnection made. The framing, i.e., the legs 14 and the struts 16, etc., can be thereafter built up to form the finished jacket.

Once construction to the jacket is completed and weather conditions are satisfactory, the graving dock can be flooded until the interconnected structures assume a floating condition. Thereafter the combined floating structures can be towed to a desired offshore location. Once the desired location is reached, the supportive buoyant structure can be ballasted to turn the two structures as a unit upright in the water. Ultimately the jacket 10 is lowered to the floor of the body of water and quickly anchored thereto by means of a number of pilings extending through the individual piling guides 18. Once the jacket is anchored, the connections between the supportive buoyant structure and the tower jacket can be broken and the supportive buoyant structure recovered for reuse in connection with another tower.

Referring now to FIGS. 2 through 5, the connecting apparatus of the invention can be seen in more detail. As perhaps best illustrated in FIGS. 2 and 4, the apparatus is comprised of pairs of mating stanchions 52*a* and 52*b* which are like in number to the means employed in connecting these stanchions together. As can be appreciated from an examination of FIG. 4, the stanchion means 52 (i.e. a pair 52*a* and 52*b*) individually extend from a suitable structural portion 54 of the tower jacket 10 and from a similarly suitable structural portion 56 of the supportive buoyant structure 12 (52*a* is connected into 54 and 52(*b*) into 56).

Figure 4:
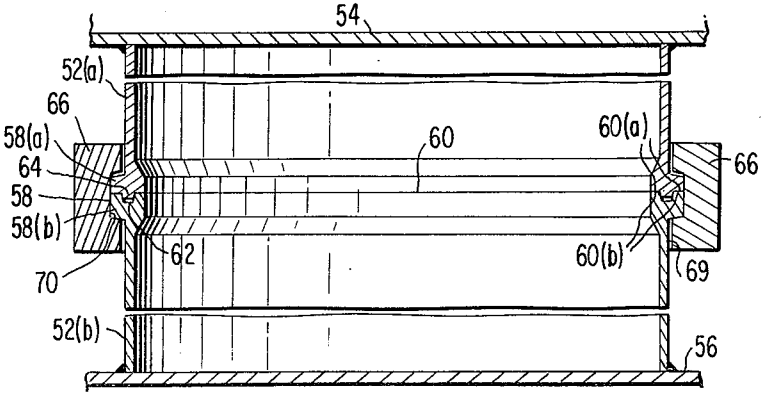
FIG. 4 is a vertical sectional view of the mating stanchions extending between the offshore tower jacket and the supportive buoyant structure.

Preferably each stanchion element is welded to either the tower jacket or the supportive buoyant structure such that the stanchions extend rigidly and generally vertically between the two structures. In this way, the stanchions extend into coaxial mating engagement as shown in FIG. 4 in such a way that the stanchions can be clamped together by suitable clamping means when it is desired to connect together the tower jacket and the buoyant structure. The stanchions preferably extend between the tower jacket and the buoyant structure a distance sufficient to maintain the tower jacket out of the water as the jacket is transported to a desired offshore location. In maintaining the jacket out of the body of water the significant advantage is gained that the jacket causes no hydrodynamic resistance to the movement of the buoyant structure through the body of water.

As perhaps best illustrated in FIG. 4, the stanchions 52(*a*) and 52(*b*) carry mating axial surfaces having annular lips 58(*a*) and 58(*b*) respectively which extend about the circumference of the mating surfaces so that a single bead or rim 58 having converging top and bottom surfaces is formed about the stanchions at the interface thereof whenever the stanchions are properly mated. The tower jacket and the buoyant structure are rigidly connected by clamping these lips 58(*a*) and 58(*b*) together to maintain the stanchions in mated relation.

The mating surfaces extend about and form the axial edge surfaces of the stanchions and define opposed annular edges 60(*a*) and 60(*b*). An annular groove 62 carried by stanchion 52(*b*) extends in a direction parallel to the longitudinal axis of the stanchions when mated and interrupts the annular mating plane 60 of the stanchions 52(*a*), 52(*b*). Similarly, an annular tongue 64 carried by stancion 52(*a*) extends in a direction parallel to the longitudinal axis of the stanchions and interrupts the annular mating plane 60 of the stanchions. The annular tongue 64 is dimensioned to fit snugly within the annular groove 62. The annular character of the tonque and groove connection between the opposed stanchions affords universal resistance to any lateral movement between the two structures. In other words, regardless of any movement of the buoyant structure caused by winds or waves, there should be no lateral slipping of the tower jackets as a consequence of lateral movement between the stanchions at the mating surfaces 60(*a*), 60(*b*), and 64 thereof.

Associated with each stanchion 52(*b*) on the buoyant structure is a selectively operable (remotely or on-site) clamping and locking mechanism 51. This structure will now be described.

As perhaps best illustrated in FIG. 4, the lips 58(*a*), 58(*b*) of the stanchions are clamped together to securely mate the stanchions 52(*a*), 52(*b*) by appropriate clamping means preferably in the form of C-clamps 66, 67 of means 51. As will be better appreciated in the course of subsequent discussion, the clamping means, i.e., the C-clamps 66, 67 are carried by the buoyant structure in reciprocally movable relation therewith and serve to rigidly but releasably clamp together the tower jacket and the buoyant structure.

Figure 3:
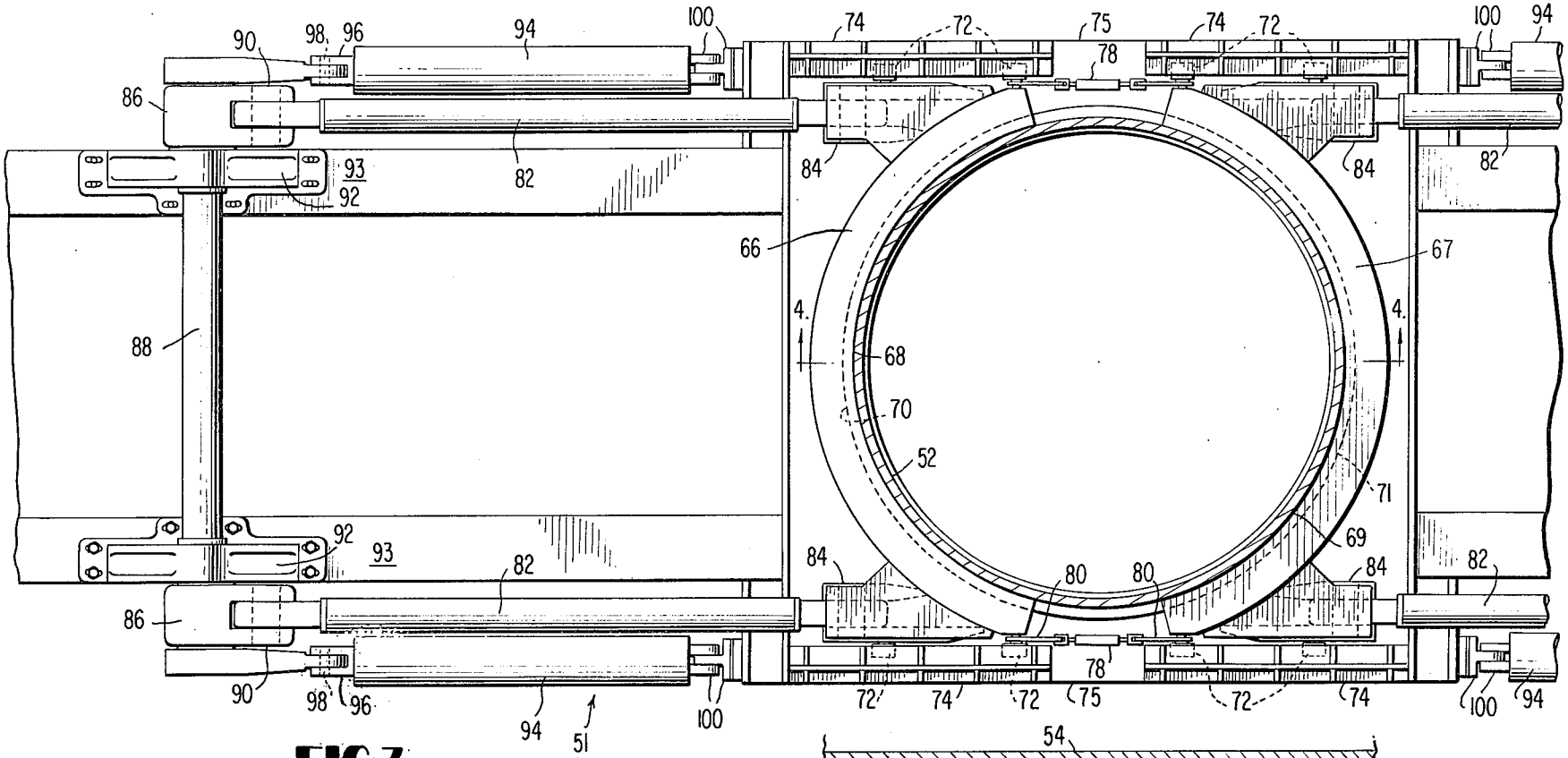
FIG. 3 is a plan view of a preferred embodiment of an apparatus intended to connect together the offshore tower jacket and the supportive buoyant structure.
Figure 5:
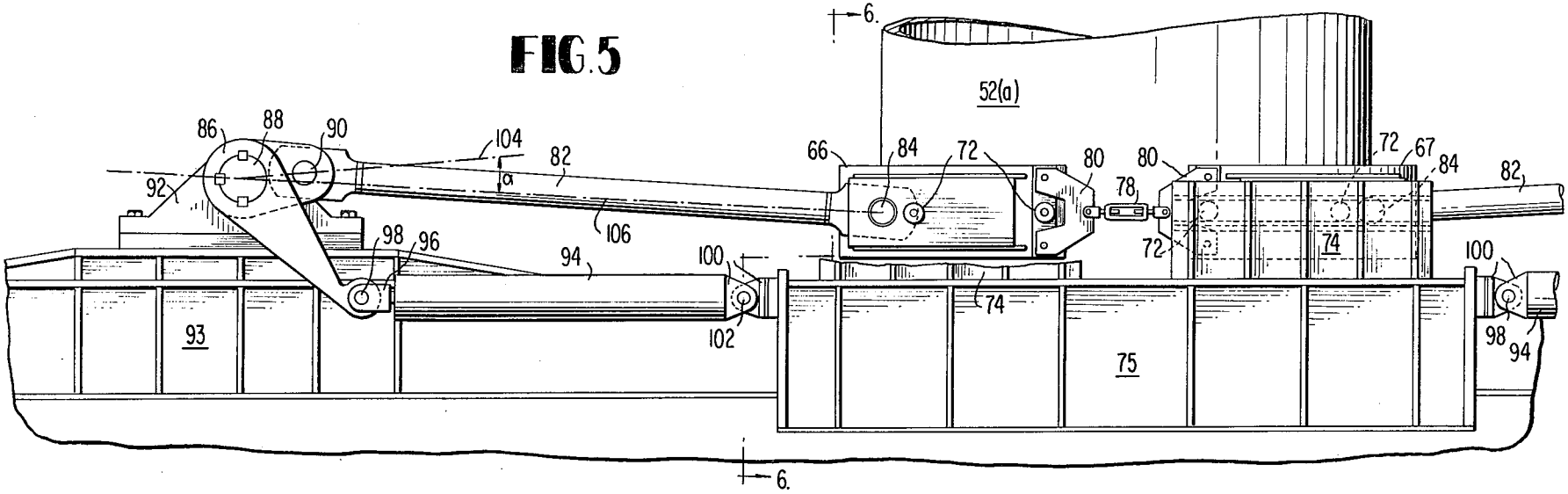
FIG. 5 is a side view of a preferred embodiment of an apparatus intended to connect the offshore tower jacket and the supportive buoyant structure with the apparatus in a locked condition.

As perhaps best appreciated from FIGS. 3 and 5, the connecting apparatus preferably involves at least one, circularly arcuate C-clamp 66 having a inner circular surface 68 with a radius of curvature essentially equal to that of the outer cylindrical surfaces of the stanchions. As illustrated in FIG. 4, each C-clamp 66 employed carries a radially outwardly directed groove 70 disposed in the inner circular surface 68. The groove 70 has diverging upper and lower walls and is dimensioned to conformingly receive and clamp together the lips 58(*a*), 58(*b*) extending about the mating axial surfaces of the stanchions. Preferably, two opposed C-clamps 66, 67 are employed as illustrated in FIG. 3. (Clamp 67 having a stanchion confirming and engaging face 69 and lip embracing groove 71). These C-clamps together partially surround the stanchions 52(*a*), 52(*b*) in clamping the mating rims 58(*a*), 58(*b*) together. The clamping of the mating rims together, in combination with the particular mating configuration of these rims as provided by annular tongue 64 and annular groove 62, serves to effect a strong, rigid connection between the jacket and buoyancy structures which is capable of resisting forces exerted in the course of turning the jacket and buoyant structure upright in the body of water. The integrity of the connection is, of course, also helpful in maintaining a safe, secure connection between the two structures as the jacket is floated to a desired offshore location.

Figure 6:
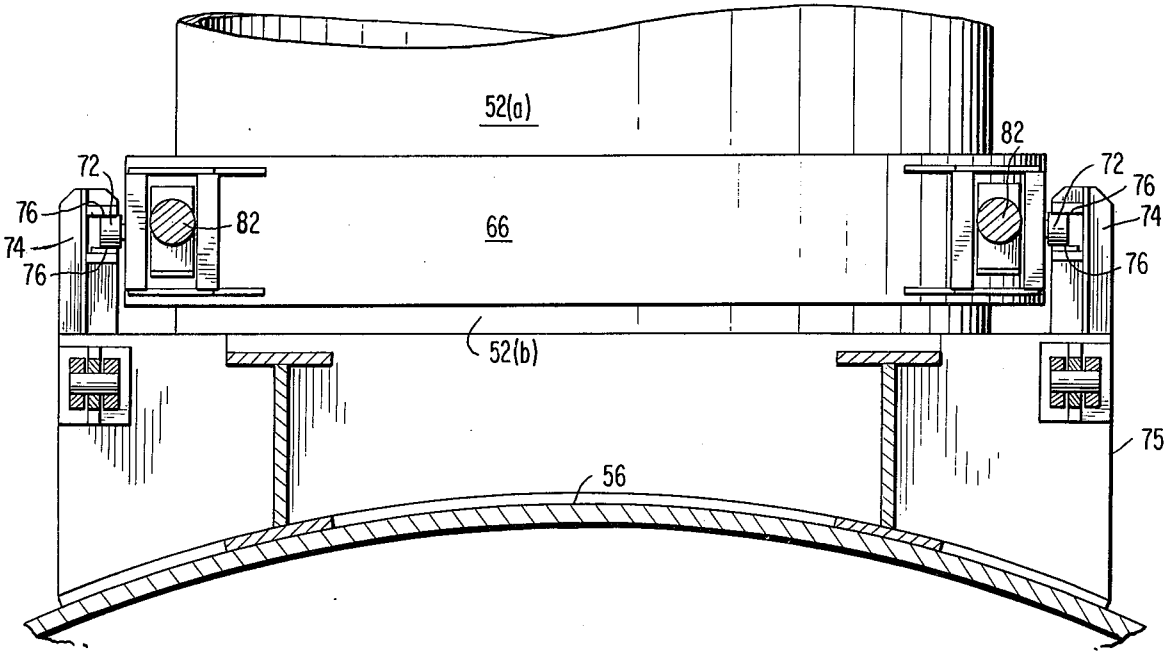
FIG. 6 is a vertical sectional view taken along the lines 6—6 of FIG. 5.

It is important that the movement of the C-clamps 66, 67 be carefully controlled so that the lips 58(*a*), 58(*b*) can be enclosed and clamped together. Thus, the C-clamps should move in directions perpendicular to the longitudinal axes of the stanchions. To control the movement of the C-clamps 66 as described, a plurality of rollers 72 (FIG. 6) extend laterally from the C-clamps 66, 67. The rollers extend into channels formed by tracks 74 which extend away from the stanchions and which are secured to the buoyant structure through suitable bases 75. The tracks 74 present opposed surfaces 76 to the rollers 72 which guide the reciprocating movement of the C-clamps and concurrently restrain the C-clamps against movement parallel to the longitudinal axes of the stanchions.

The C-clamps 66, 67 can be maintained in position around the stanchions in the course of the construction of the tower jacket by removable turnbuckles 78 extending between the ends of opposed C-clamps. Each turnbuckle can be connected between the C-clamps through opposed brackets 80, each directly connected to an end of a C-clamp. The turnbuckles 78 can thus be employed to draw the C-clamps into position and to hold the C-clamps in place during assembly. Ultimately, the turnbuckles may be removed to facilitate movement of each C-clamps away from the stanchions during operation of the system.

The apparatus 51 of the invention is also comprised of elongated structural linking means which serve to reciprocally move the clamping means, i.e., the C-clamps 66, 67, relative to the buoyant structure 12. A pair of such linking means is provided, one such means being mounted on each side of each clamp. One representative linking means will now be described.

Preferably each linking means takes the form of a link 82 which may be elongate in shape and which is pivotally connected to a C-clamp, such as a clamp 66, through a suitable pivot pin 84. The elongated links of clamps 66, 67 are opposed, that is two links are disposed in opposing relation on each clamp side. Thus, as illustrated in FIG. 3, each of the opposed C-clamps 66, 67 is served by two elongated links. Clearly, more than two links could be employed; however, two elongated links for each C-clamp is preferred.

The elongated links 82 can be fabricated from a number of different materials. However, for reasons to be discussed in more detail later, it may be essential that each link be flexible to a degree. This is not to say the link should be flimsy, rather, the link should combine the qualities of structural rigidity with a degree of resilience such as that afforded by a heavy, cylindrical length of structural steel.

Suitable bellcranking means in apparatus 51 are employed in the invention to reciprocally move the elongated links and thus the C-clamps into and out of clamping relation with the tower jacket and the supportive buoyant structure. Preferably the bellcranking means associated with each clamp 66 or 67 involves tandem bellcranks positioned on opposite sides of a pair of mating stanchions and disposed at opposite ends of and keyed to a unitary axle 88. There is thus afforded a bellcrank 86 for each elongated link 82. By means of a suitable pivot pin 90, one of the two limbs of each such bellcrank pivotally carries the end of an elongated link 82 opposite that connected to a C-clamp. The tandem bellcranks are pivotally connected to the buoyant structure through unitary axles 88 by means of pillow blocks 92 mounted on suitable bases 93 connected to the buoyant structure. The bellcranks associated with each clamp are thus constrained to rotate in unison about an axis which is normally horizontal.

Rotation of the bellcranks 86 and the associated unitary axles 88 serves to move the elongated links 82 and the C-clamps connected thereto either into or out of clamping relation with the stanchions. By rotating tandem bellcranks in one direction, the C-clamp associated therewith can be moved into clamping relation with the stanchion, while rotation of the bellcranks in the opposite direction serves to withdraw the C-clamps from the clamping relation. Thus, the offshore tower jacket and the supportive buoyant structure can be reliably connected and disconnected since the manner in which the clamping means is operated is quite simple and reliable. Furthermore, the clamping means maintaining the stanchions in clamped relation is not destroyed or otherwise damaged in the course of disconnection so that the apparatus serving to connect the tower jacket and the buoyant structure together can be reused over essentially as many cycles as the supportive buoyant structure. Only the stanchions rigidly projecting from the tower jacket will be lost when the jacket is erected.

The invention is also comprised of suitable rotating means connected to the bellcranks. Preferably, the rotating means is comprised of a number of hydraulic motors, one of which connects the limb of each bellcrank, not connected to the elongated link 82, and the base 75 connected to the buoyant structure. Each hydraulic motor is preferably pivotally connected to the limb of a bellcrank through a suitable bracket 96 and pivot pin 98. Similarly, each such hydraulic motor can be connected to a base 75 through brackets 100 and a pivot pin 102. Preferably, the hydraulic motors employed are hydraulic piston and cylinder assemblies which are operable to expand and contract to rotate the bellcranks. The hydraulic motors 94 are controlled in such a way that the expansion or contraction thereof is synchronized in order to move the C-clamps 66, 67 simultaneously out of or into the desired clamping relation with the stanchions. This movement can be controlled in any of a number of desirable ways. In any case, the expansion or contraction of the hydraulic motors serves to positively connect or disconnect the tower jacket and the supportive buoyant structure.

Because a positive disconnection is effected when the jacket and buoyant structure are disconnected, the supportive buoyant structure is dependably freed from the jacket so that it can be readily moved away from the jacket and recovered. In addition, considering the amount in which the C-clamps can be levered by the bellcranks into clamping relation with the stanchions, and considering the configuration of the C-clamps themselves, the connection afforded between the stanchions is quite dependable structurally. In other words, the connection is quite heavy-duty and may not be as vulnerable to failure as other devices of the prior art. Furthermore, the apparatus described does not subject the workmen employed in the construction and placement of the jacket to any significant danger. A very simple, predictable movement is employed in either connecting or disconnecting the supportive buoyant structure and the tower jacket and the clamping assembly is quite safe to use and work around.

Referring now to FIGS. 5, 7, and 8, the sequence of operation of the connecting apparatus is illustrated. In FIG. 5 the connecting apparatus is shown with the C-clamps 66 in full clamping relation with the stanchions 52(*a*), 52(*b*). A turnbuckle 78 is shown in place; however, if desired, this element of the invention could be removed at an earlier stage. If the turnbuckle has not yet been removed, it is removed in this phase of the operation.

Each bellcrank may be positioned relative to the mating stanchion means 52 so that a line 104 orthogonally intersecting the axes of rotation of the bellcrank 86 and the link 82 connected thereto forms an angle $\alpha$ with the longitudinal axis 106 of the link 82, as shown in FIG. 5. Normally, if the bellcranks are in this posture, the hydraulic motors 94 are fully contracted as illustrated in FIG. 5. This arrangement, in essence, provides an "over center", self securing, clamping arrangement.

When it is desired to disconnect the supportive buoyant structure from the tower jacket, as when the jacket has been turned upright and placed on the floor of the body of water, movement of the type illustrated in FIGS. 7 and 8 is initiated. As illustrated in FIG. 7, expansion of the hydraulic motors 94 is begun. If the bellcranks are positioned as described, this causes rotation of the bellcranks 86 such that the angle $\alpha$ between the lines 104 and 106 shown in FIG. 5 decreases to zero. This will cause the elongated links 82 to resiliently bow as illustrated in FIG. 7 and will force the C-clamps 66, 67 into even tighter relation with the stanchions 52. As a result, any tendency toward freezing of the C-clamps as a result of an accumulation of dirt or other debris can be reduced. Once the angle $\alpha$ has been decreased to zero magnitude, continued rotation of the bellcranks 86 in response to continued expansion of the hydraulic motors 94 causes the angle $\alpha$ to continuously increase. As a result, the elongated links 82 and the C-clamps 66, 67 are moved away from the stanchion means 52, thus moving the C-clamps out of rigidly clamping relation with the mating stanchions 52(*a*), 52(*b*). Ultimately, the hydraulic motors 94 are fully expanded and the bellcranks fully rotated to fully withdraw the C-clamps from the area of the stanchions 52(*a*), 52(*b*).

The positioning of the bellcranks so as to form the angle $\alpha$ illustrated in FIG. 5, assists in self-locking the C-clamps about the stanchions 52. Positive action of the hydraulic motors is required to move the bellcranks and thus the C-clamps, in disconnecting the supportive buoyants structure from the offshore tower jacket. It must be emphasized that throughout the movement of the C-clamps described in the foregoing, the rollers and tracks 72 and 74, respectfully, illustrated in FIG. 6 constrain the C-clamps to movement only in a direction along a line generally perpendicular to the longitudinal axes of the stanchions.

The method of the invention involves a number of discrete steps and is normally begun by axially mating opposed stanchions, extending vertically between the buoyant structure 12 and the tower jacket 10 so that the jacket is carried by the buoyant structure. This axial mating is accomplished by inserting the annular tongue 64 depending from the mating surface of one of the stanchions into the annular groove 62 of the mating surface of the other stanchion. The stanchions are mated in such a way that the upper ends of the stanchions extending between the structures and thus the jacket are maintained above the surface of the water so that the jacket cannot resist movement of the supportive buoyant structure through the water to a desired offshore location.

The mating surfaces of the stanchions are next clamped together by enclosing the mating annular lips 58(*a*), 58(*b*) extending about the periphery of the stanchions closely adjacent the mating surfaces as mentioned earlier. The annular lips are enclosed at least partially within at least one C-clamp 66 or 67. The C-clamps preferably serve to enclose opposed, converging top and bottom portions of the annular lips. Once enclosed by the C-clamps 66, 67, the annular lips 58(*a*), 58(*b*) are forced together. Thereafter, the mating surfaces of the stanchions are locked positively, in the clamped relation described, before transporting the tower jacket and the buoyant structure to a desired offshore location. This locking is accomplished by rotating the bellcranks 86 to a extremum angular position (FIG. 5). As a consequence, the elongated links 82 connected thereto are levered against the C-clamps 66, 67 to force the C-clamps into clamping relation with the stanchions. Preferably, each bellcrank is positioned so that a line 104 orthogonally intersecting the axes of rotation of the bellcrank and the link, where the link is pivotally connected thereto, forms an angle $\alpha$ with the longitudinal axis of the link.

Subsequent to transporting the tower jacket and the supportive buoyant structure to a desired offshore location, the mating surfaces of the stanchion can be positively unlocked from the clamped relation described earlier. This is accomplished by rotating the bellcranks from the extremum angular position illustrated in FIG. 5, through the position illustrated in FIG. 7, and at least to if not beyond the position illustrated in FIG. 8. In the course of this movement the angle $\alpha$ decreases to zero, as illustrated in FIG. 7, and thereafter increases continuously as the bellcranks are rotated from the extreme angular position illustrated in FIG. 5 toward the angular position illustrated in FIG. 8. In other words, elongated links are levered to force the C-clamps out of clamping relation with the stanchions as a consequence of the rotation of the bellcranks.

Ultimately, the mated surfaces of the stanchions are fully released from the clamped relation effected by the C-clamps as perhaps best illustrated in FIG. 8. Throughout the course of the movement described, each C-clamp is constrained against movement other than that along a line perpendicular to the longitudinal axes of the stanchions. This is accomplished through the rollers 72 and tracks 74 illustrated in FIG. 6.

SUMMARY OF THE ADVANTAGES OF THE INVENTION

It will be appreciated that, in providing a method and apparatus for connecting and disconnecting a supportive buoyant structure to and from an offshore tower jacket according to the invention, certain significant advantages are obtained.

A particular advantage of the invention is that a supportive buoyant structure can be rigidly locked in connection with an offshore tower jacket in a manner capable of resisting forces which may be exerted as the jacket is turned upright and placed on the floor of the body of water.

The fact that a supportive buoyant structure can be positively connected to an offshore tower jacket and thereafter positively disconnected to permit the supportive structure to be quickly moved away from the jacket, affords another advantage.

Still another advantage of the invention is that the method and apparatus of the invention is capable of universally resisting movement of an offshore tower jacket aboard a supportive buoyant structure regardless of movement induced in the assembly as a whole by waves and wind.

Yet still another advantage of the invention is that the connection effected between the supportive buoyant structure and the offshore tower jacket is heavy-duty and of sufficient strength that loads incurred in the course of transportation and erecting the jacket can be effectively resisted.

A further advantage of the invention is that the supportive buoyant structure and the offshore tower jacket can be connected or disconnected in a highly reliable manner.

The fact that the apparatus employed to effect the connection between the offshore tower jacket and the supportive buoyant structure is reusable over essentially the same number of cycles as the supportive buoyant structure, affords a still further advantage.

Yet still a further advantage of the invention resides in the fact that the offshore tower jacket can be connected to the supportive buoyant structure in a manner such that the jacket is maintained in a position above the surface of the body of water to thereby avoid undue resistance to the movement of the assembly resulting from hydrodyanamic drag.

Another advantage of the invention is that the apparatus employed is safe to use and work around while the jacket is being constructed, transported to a desired offshore location, and/or thereafter erected.

In describing the invention, reference has been made to a preferred embodiment. However, those skilled in the art and familiar with the disclosure of the invention may recognize additions, deletions, substitutions, or other modifications which would fall within the purview of the invention as defined in the claims.

What is claimed is:

1. An apparatus for connecting and disconnecting a supportive buoyant structure intended to transport and erect an offshore tower jacket alternately to and from the tower jacket, said apparatus comprising:

clamping means carried by the buoyant structure in reciprocally movable relation therewith for rigidly but releasably clamping together the tower jacket and the buoyant structure;

elongated, structural linking means for reciprocally moving said clamping means relative to the buoyant structure, said linking means being pivotally connected at one end to said clamping means;

bellcranking means for reciprocally moving said linking means to thereby move said clamping means alternately into and out of clamping relation with the tower jacket and the supportive buoyant structure, said bellcranking means being pivotally connected to the buoyant structure for rotation about an axis which is normally horizontal, and said bellcranking means pivotally carrying the remaining end of said linking means; rotating means connected to said bellcranking means for rotating said bellcranking means to reciprocally move said linking means and said clamping means relative to the buoyant structure to thereby move said clamping means alternately into or out of clamping relation with the tower jacket and the supportive buoyant structure to positively connect or disconnect the tower jacket and the supportive buoyant structure;

pairs of mated stanchions like in number to said in number to said clamping means and individually extending from the tower jacket and the buoyant structure into coaxial, mating engagement, the stanchions of each pair being clamped together by said clamping means when it is desired to connect together the tower jacket and the buoyant structure;

said stanchions each carrying mated axial surfaces having annular lips extending about the circumference thereof such that a single bead is formed about the circumference of the stanchions at the interface thereof when the stanchions are mated, said clamping means clamping said lips together to maintain said stanchions in mated relation and the tower jacket and the buoyant structure rigidly connected; said bellcranking means including opposed bellcranking means positioned on opposite sides of a pair of mating stanchions; and said linking means including opposed linking means positioned on opposite sides of said pair of mating stanchions, each of said opposed linking means extending from one of said opposed bellcranking means to said clamping means.

2. The apparatus for connecting and disconnecting a supportive buoyant structure alternately to and from an offshore tower jacket as defined in claim 1 wherein:

said opposed bellcranking means comprise tandem bellcranks disposed at opposite ends of a unitary axle; and said opposed linking means comprise elongated, tandem links each extending between one of said bellcranks and said clamping means.

3. The apparatus for connecting and disconnecting a supportive buoyant structure alternately to and from an offshore tower jacket as defined in claim 2 wherein said clamping means comprises:

opposed, circularly arcuate C-clamps, each having an inner, circular surface dimensioned to receive and clamp together said lips extending about the mating axial surfaces of said stanchions.

4. The apparatus for connecting and disconnecting a supportive buoyant structure alternately to and from an offshore tower jacket as defined in claim 3 further comprising:

a plurality of rollers extending laterally from said C-clamps; and tracks extending away from said stanchions and presenting opposed surfaces to said rollers to guide said reciprocating movement of said C-clamps and concurrently restrain said C-clamps against movement parallel to the longitudinal axes of said stanchions.

5. The apparatus for connecting and disconnecting a supportive buoyant structure alternately to and from an offshore tower jacket as defined in claim 3 wherein:

each bellcrank has two limbs, one of which pivotally carries one end of one of said elongated links; and each bellcrank is positioned relative to said mating stanchions so that a line orthogonally intersecting the axes of rotation of said bellcrank and said link connected thereto forms an angle with the longitudinal axis of said link which progressively decreases to zero and therefter increases as said bellcrank is rotated to move a C-clamp out of rigidly clamping relation with said mating stanchions.

6. The apparatus for connecting and disconnecting a supportive buoyant structure alternately to and from an offshore tower jacket as defined in claim 3 wherein:

each bellcrank has two limbs, one of said limbs pivotally carrying one end of a link while the other of said limbs of each bellcrank is connected to said rotating means; and said rotating means comprises a plurality of hydraulic motors each interconnecting said other limb of a bellcrank and the buoyant structure, said hydraulic motor being operable to expand and contract to rotate said bellcrank to alternately move a C-clamp out of and into clamping engagement with said stanchions.

7. The apparatus for connecting and disconnecting a supportive buoyant structure alternately to and from an offshore tower jacket as defined in claim 6 wherein:

each bellcrank is positioned relative to said mating stanchions so that a line orthogonally intersecting the axes of rotation of said bellcrank and said link connected thereto forms an angle with the longitudinal axis of said link which progressively decreases to zero and thereafter increases as said bellcrank is rotated to move a C-clamp out of rigidly clamping relation with said mating stanchions to thereby lock said apparatus when said C-clamp is in a clamping relation with said stanchions.

8. The apparatus for connecting and disconnecting a supportive buoyant structure alternately to and from an offshore tower jacket as defined in claim 7 wherein said mating axial surfaces of said stanchions are comprised of:

surfaces extending about and forming the axial edge surfaces of said stanchions to define opposed, annular planes;

annular groove extending in a direction parallel to the axis of said stanchions when mated and interrupting said annular plane of one of said stanchions; and an annular tongue extending in a direction parallel to the axis of said stanchions when mated and interrupting said annular plane of the other of said stanchions, said annular tongue located on the other of said stanchions and dimensioned to fit relatively snugly within said annular groove when said stanchions are mated.

9. The apparatus for connecting and disconnecting a supportive buoyant structure alternately to and from an offshore tower jacket as defined in claim 8 wherein:

said stanchions extend between the tower jacket and the buoyant structure a distance sufficent to maintain the tower jacket out of the water as the tower jacket is transported to a desired offshore location.

10. The apparatus for connecting and disconnecting a supportive buoyant structure alternately to and from an offshore tower jacket as defined in claim 9 further comprising:

a plurality of rollers extending laterally from said C-clamps; and tracks extending away from said stanchions and presenting opposed surfaces to said rollers to guide said reciprocating movement of said C-clamps and concurrently restrain said C-clamps against movement parallel to the longitudinal axes of said stanchions.

11. A method of connecting and disconnecting a supportive buoyant structure alternately to and from the tower jacket, said method comprising the steps of:

axially mating opposed stanchions extending between the buoyant structure and the tower jacket, with the tower jacket being carried by the buoyant structure;

clamping the mated stanchions together with spaced clamping means;

positively locking the mated stanchions in said clamped relation prior to transporting the tower jacket and the buoyant structure to a desired offshore location; positively unlocking the mating stanchions from said clamped relation subsequent to transporting the tower jacket and the buoyant structure to a desired offshore location;

releasing the mating stanchions from said clamped relation;

supporting said clamping means on said buoyant structure at locations separately spaced from said mated stanchions for guided and restrained movement, into and out of clamping cooperation with said mated stanchions;

retaining said clamping means on said buoyant structure subsequent to said releasing of said mated stanchions and separation of said buoyant structure and tower jacket;

providing actuating means carried by said buoyant structure and operable to effect said guided movement of said clamping means; and effectively mutual telescoping of portions of said stanchions during said mating, with said telescoped portions being operable to resist relative, wave action induced movement between said tower jacket and said buoyant structure.

12. Apparatus for connecting and disconnecting a supportive buoyant structure alternately to and from the tower jacket, said apparatus comprising:

axially matable, opposed stanchions operable to extend between the buoyant structure and the tower jacket, with the tower jacket being carried by the buoyant structure;

spaced clamping means for clamping the mated stanchions together;

locking means for positively locking the mated stanchions in said clamped relation prior to transporting the tower jacket and the buoyant structure to a desired offshore location;

unlocking means for positively unlocking the mated stanchions from said lockingly clamped relation subsequent to transporting the tower jacket and the buoyant structure to a desired offshore location while maintaining a clamped relation between said stanchions;

means for releasing the mated stanchions from said clamped relation;

guiding and restraining means supporting said clamping means on said buoyant structure at locations separately spaced from said mated stanchions for guided movement, into and out of clamping cooperation with said mated stanchions; said guiding and restraining means being operable to retain said clamping means on said buoyant structure while said buoyant means is separated from said tower jacket;

actuating means, carried by said buoyant structure, and operable to effect said guided movement of said clamping means;

said matable, opposed stanchions including mutually telescopable means operable, when said stanchions are mated, to mutually telescope and resist relative, wave action induced movement between said tower jacket and said buoyant structure.

13. Apparatus for connecting and disconnecting a supportive buoyant structure alternately to and from an offshore tower jacket as defined in claim 12 wherein said means for clamping the mating stanchions together comprises:

mating annular lips carried by said opposed stanchions; and opposed C-clamps for enclosing said mating annular lips.

14. Apparatus described in claim 13 wherein said locking means and said unlocking means comprise:

over-center locking and unlocking means operable to lockingly maintain said clamped relation of said mated stanchions, and exert compression between said clamping means and said mated stanchions during the unlocking of said mated stanchions.

* * * * *